US008508463B2

(12) United States Patent
Liu

(10) Patent No.: US 8,508,463 B2
(45) Date of Patent: Aug. 13, 2013

(54) BACKLIGHT CONTROL CIRCUIT

(75) Inventor: Jing-Meng Liu, Jubei (TW)

(73) Assignee: Richtek Technology Corporation, Hsin-Chu (TW)

( * ) Notice: Subject to any disclaimer, the term of this patent is extended or adjusted under 35 U.S.C. 154(b) by 1715 days.

(21) Appl. No.: 11/906,512

(22) Filed: Oct. 2, 2007

(65) Prior Publication Data

US 2008/0094008 A1 Apr. 24, 2008

(30) Foreign Application Priority Data

Oct. 19, 2006 (TW) ..... 95138632 A

(51) Int. Cl.
*G09G 3/36* (2006.01)

(52) U.S. Cl.
USPC ..... 345/102; 345/211; 345/213; 345/690; 315/291; 315/297

(58) Field of Classification Search
USPC ..... 345/102, 211–213, 690; 315/291, 315/294, 297, 307; 323/282, 283, 265
See application file for complete search history.

(56) References Cited

U.S. PATENT DOCUMENTS

| | | | | |
|---|---|---|---|---|
| 4,099,054 | A * | 7/1978 | Okumura et al. | 250/306 |
| 4,686,617 | A * | 8/1987 | Colton | 363/56.1 |
| 5,287,375 | A * | 2/1994 | Fujimoto | 372/38.02 |
| 7,365,718 | B2 * | 4/2008 | Tsuchida et al. | 345/82 |
| 8,004,201 | B2 * | 8/2011 | Hsueh et al. | 315/193 |
| 2004/0233144 | A1 * | 11/2004 | Rader et al. | 345/82 |

* cited by examiner

*Primary Examiner* — Quan-Zhen Wang
*Assistant Examiner* — Jennifer Nguyen
(74) *Attorney, Agent, or Firm* — Tung & Associates

(57) ABSTRACT

The present invention discloses a backlight control circuit, comprising: a voltage supply circuit, under control by a control signal, for receiving an input voltage and generating an output voltage; a plurality of nodes for respectively indicating the current status of corresponding light emission device paths; and a high-low voltage comparison and amplifier circuit for generating the control signal according to a voltage difference between at least two nodes.

15 Claims, 19 Drawing Sheets

BACKLIGHT CONTROL CIRCUIT

FIELD OF INVENTION

The present invention relates to a backlight control circuit, more particularly, to a backlight control circuit capable of automatically adjusting supply voltage to light emitting diodes (LEDs), for optimum power consumption.

BACKGROUND OF THE INVENTION

In a liquid crystal display (LCD), a backlight control circuit is used which controls LEDs to illuminate from the back side of an LCD screen, so that a user can observe an image from the front side of the LCD screen.

FIG. 1 shows a conventional backlight control circuit with LEDs all connected in parallel. As shown in the figure, in a backlight control circuit 20, the currents passing through LEDs L1-LN are respectively controlled by the current sources CS1-CSN. The backlight control circuit 20 comprises a lowest voltage selection circuit 21 which chooses a lowest voltage among all voltages at cathode ends of the LEDs L1-LN, and an error amplifier circuit 13 compares the lowest voltage with a reference voltage to generate a signal controlling the voltage supply circuit 11. By feedback control mechanism, the one with the lowest voltage among the nodes N11-N1N is kept at the voltage level of the reference voltage Vref; thus, the output voltage Vout is under control so that all current source circuits are provided with sufficient operating voltage for normal operation, and all LEDs can illuminate normally thereby. Moreover, to prevent the voltage supply circuit 11 from unlimitedly increasing the output voltage Vout (for example, when the error amplifier circuit 13 malfunctions), an over voltage protection circuit (OVP Ckt.) 12 is provided in the backlight control circuit 20, which detects the output voltage Vout and sends a signal to stop the voltage supply circuit 11 from increasing the output voltage Vout if the output voltage Vout is excessively high. (Depending on circuit design, the voltage supply can be totally stopped, or kept at an upper limit value. The latter is more popular in a backlight control circuit.)

FIG. 2 shows a typical structure of an over voltage protection circuit 12, wherein the output voltage Vout is monitored by comparing the voltage at the node Vsense2 with a reference voltage Vovp. The result of comparison determines a signal for controlling the voltage supply circuit 11.

Because the number of LEDs that are allowed to be connected all in parallel in the above conventional arrangement is limited, it naturally leads to connecting the LEDs partially in series and partially in parallel (series-parallel connection). FIG. 3 shows a series-parallel connection circuit for LEDs, which employs the backlight control circuit 20 shown in FIG. 1 and providing equal number of LEDs in each of the paths 101-10N.

In the conventional arrangements described above, the feedback control mechanism is designed to keep the one with the lowest current among the LED paths 101-10N above a predetermined value; ideally, this predetermined value should be the minimum current required for the LEDs in every path to operate normally. In practice, this is done by keeping the one with the lowest voltage among the nodes N11-N1N at the voltage level of the reference voltage Vref. However, between different LEDs, the voltage drops may be different because of deviations in manufacture. Hence, to ensure that every LED in every path operates normally, a circuit designer usually determines the value of the reference voltage Vref in a conservative manner; that is, the manually predetermined reference voltage Vref is usually higher than what is actually required (the optimum, lowest voltage) for the circuit. Accordingly, the output voltage Vout is unnecessarily increased, causing unnecessary power consumption.

SUMMARY

In view of the foregoing, it is therefore an objective of the present invention to provide a backlight control circuit capable of automatically adjusting supply voltage to LEDs according to the difference between LED paths, to solve the problems in prior art.

It is another objective of the present invention to provide a method for controlling light emitting devices.

In accordance with the foregoing and other objectives, and from one aspect of the present invention, a backlight control circuit comprises: a voltage supply circuit, under control by a control signal, for receiving an input voltage and generating an output voltage; a plurality of nodes for respectively indicating the current status of corresponding light emission device paths; and a high-low voltage comparison and amplifier circuit for generating the control signal according to a voltage difference between at least two nodes.

The high-low voltage comparison and amplifier circuit can be one which compares the highest voltage and the lowest voltage at the nodes, or one which compares the voltages at the nodes two by two; the two-by-two comparison can be bidirectional or unidirectional.

According to another aspect of the present invention, a method for controlling light emission devices comprises: providing a plurality of light emission device paths connected in parallel; supplying an output voltage to a connection node where the plurality of light emission device paths are coupled to; selecting a voltage node from each of the plurality of light emission device paths; comparing the voltages at least two of the voltage nodes; and controlling the output voltage according to the comparison result.

The step of comparing the voltages at the voltage nodes can be comparing the highest voltage and the lowest voltage at the voltage nodes, or comparing the voltages at the voltage nodes two by two; the two-by-two comparison can be bidirectional or unidirectional.

These and other features, aspects, and advantages of the present invention will become better understood with reference to the following description of preferred embodiments and accompanying drawings.

DESCRIPTION OF THE PREFERRED EMBODIMENTS

Figure 1:
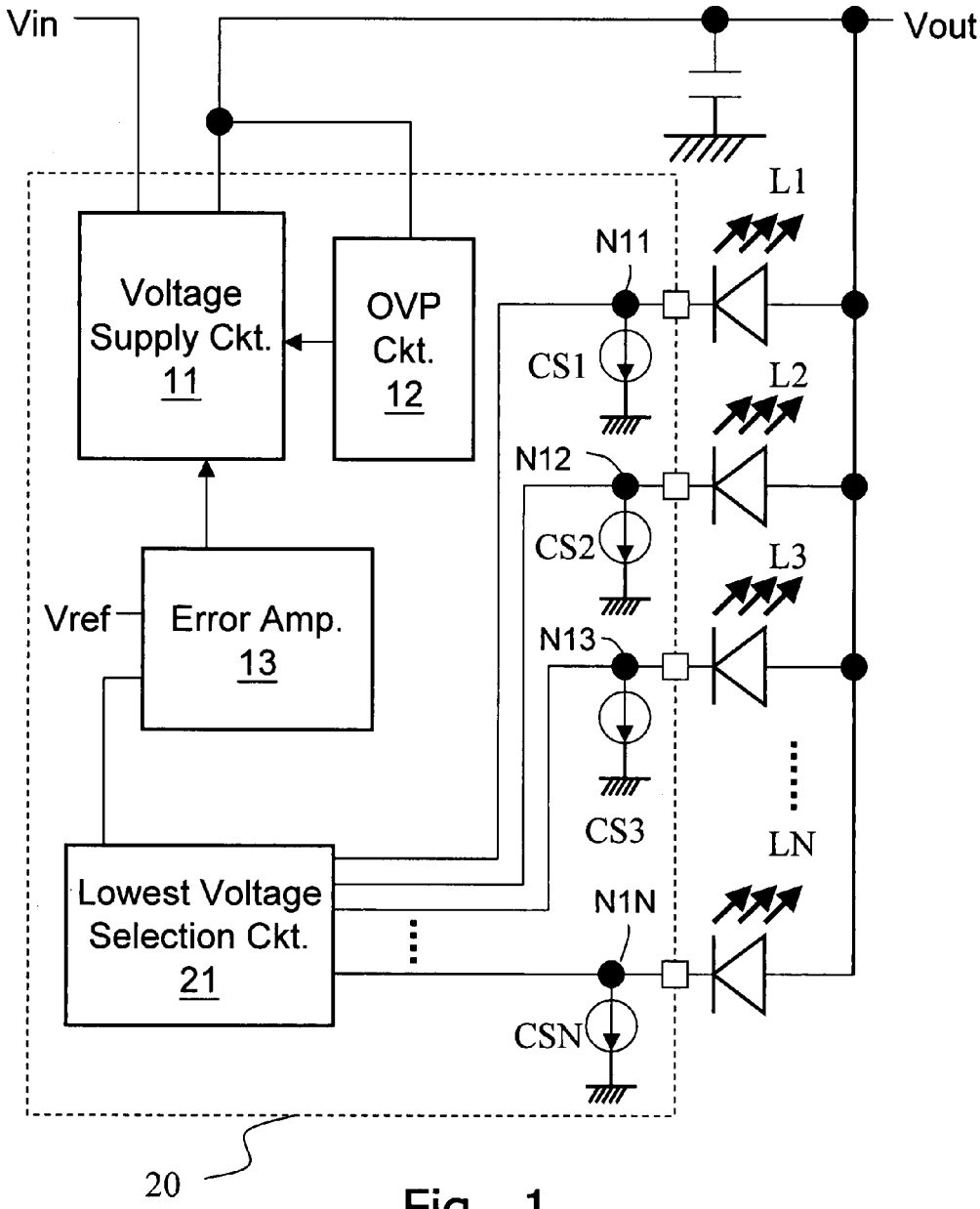
Fig. 1 (Prior Art)
FIG. 1 is a schematic circuit diagram showing a prior art circuit including LEDs which are all connected in parallel and a backlight control circuit thereof.
Figure 2:
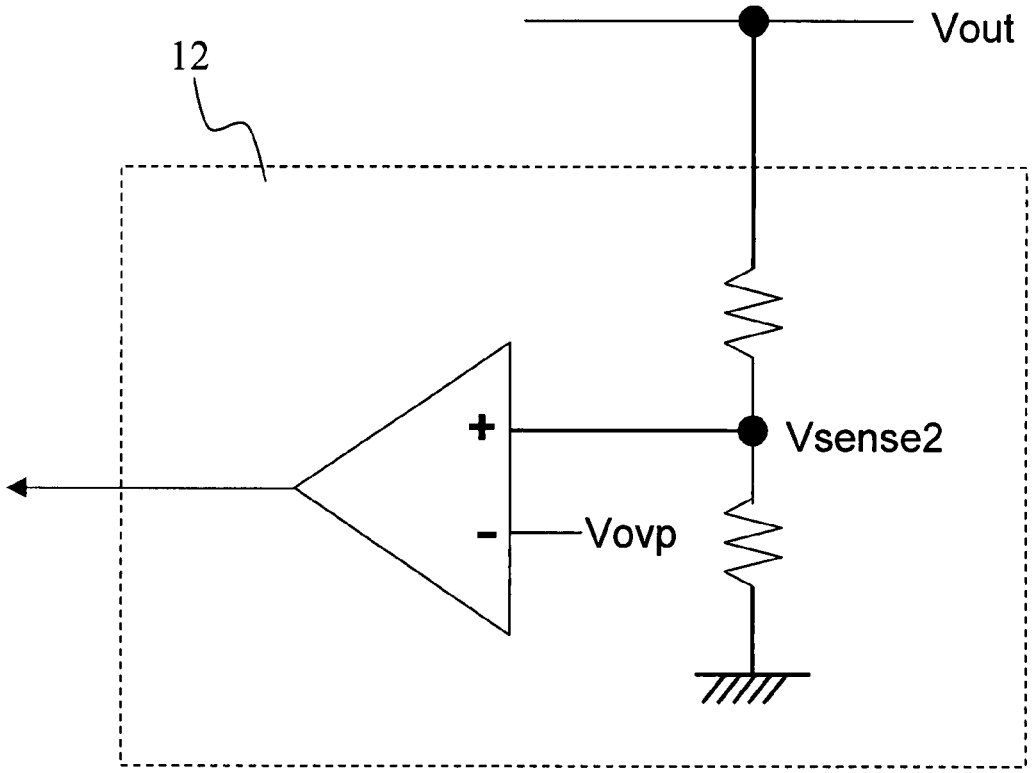
Fig. 2 (Prior Art)
FIG. 2 is a schematic circuit diagram showing a conventional over voltage protection circuit.
Figure 3:
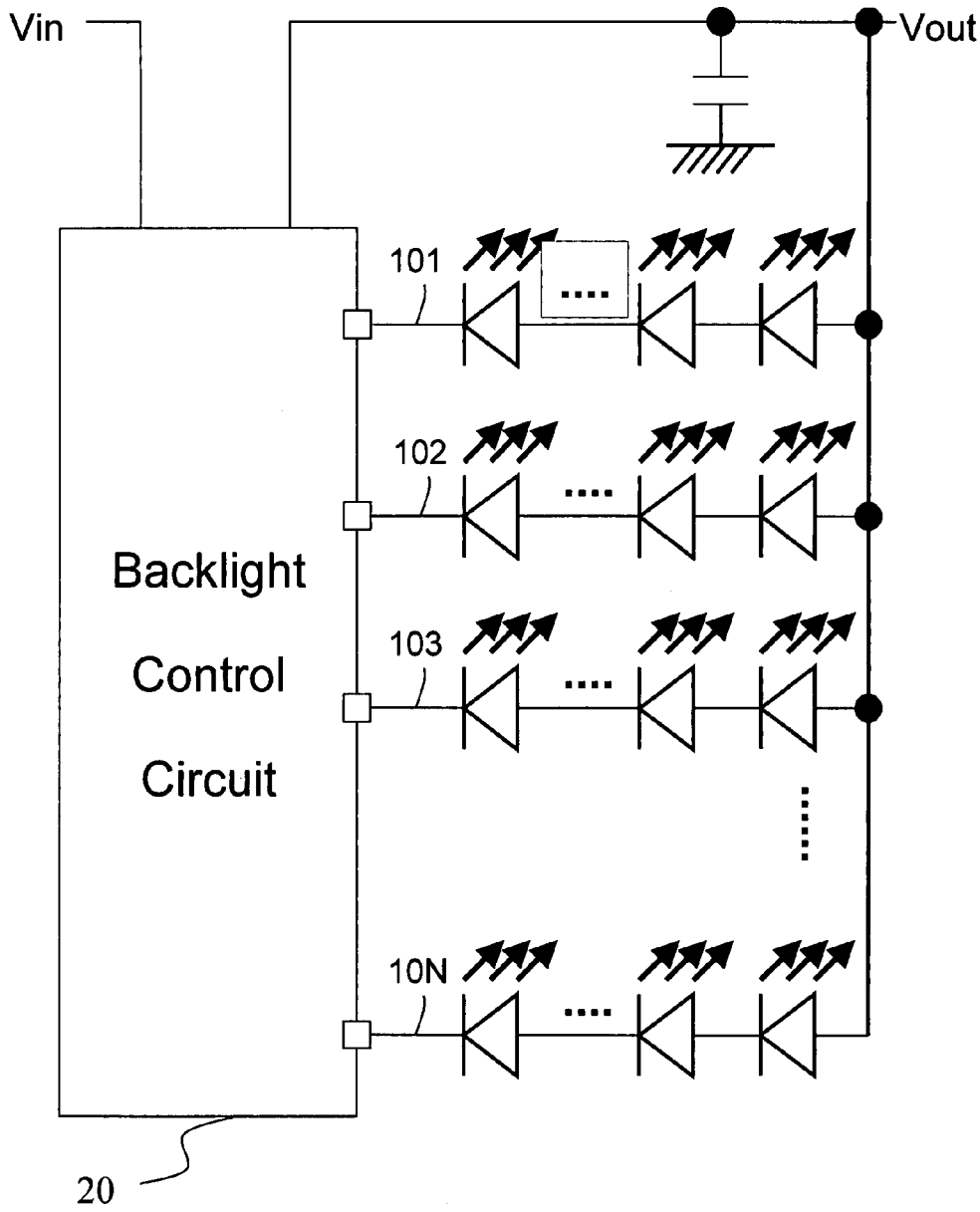
Fig. 3 (Prior Art)
FIG. 3 is a schematic circuit diagram showing a prior art circuit including LEDs which are connected partially in series and partially in parallel, and a backlight control circuit thereof.
Figure 4:
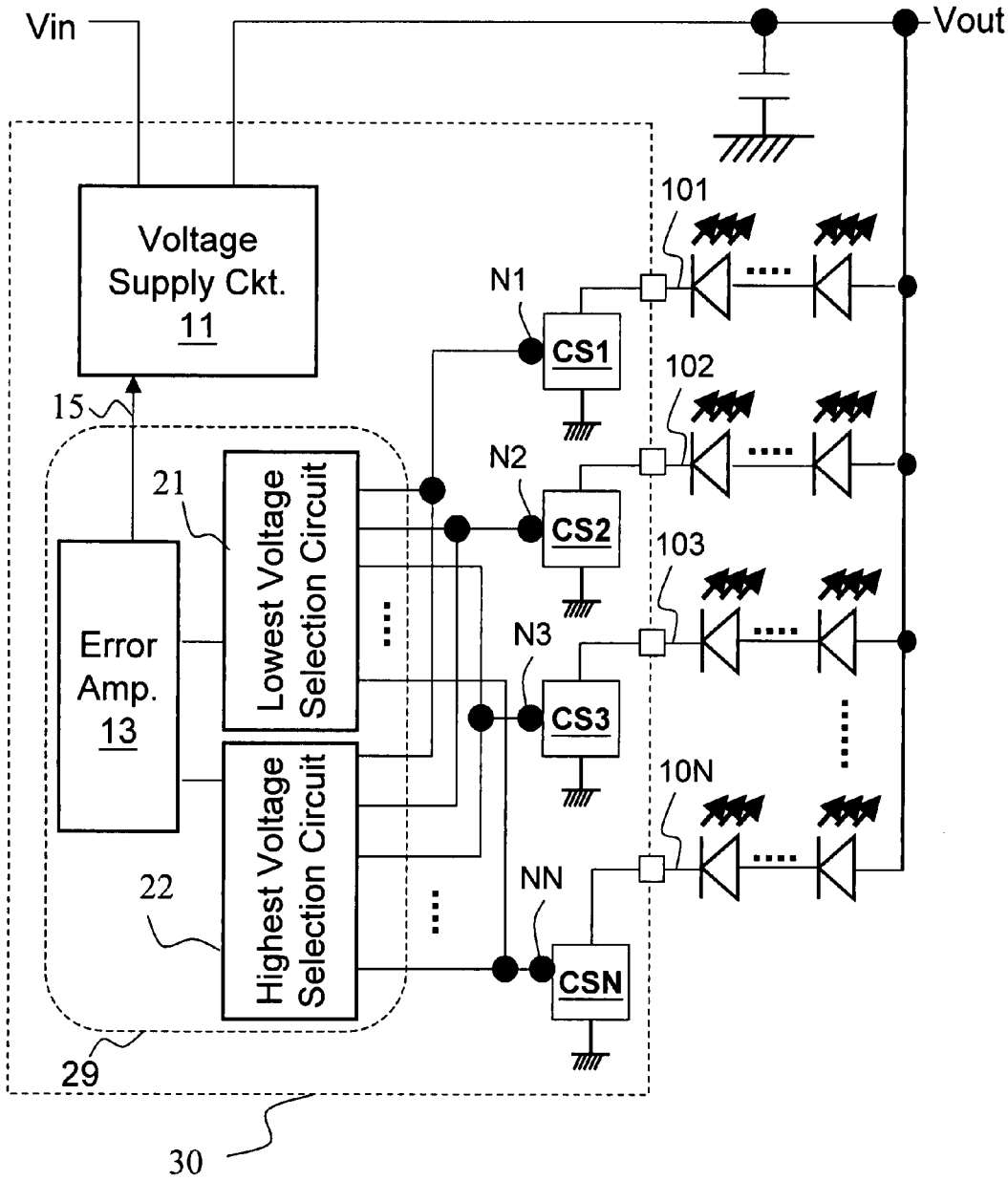
FIG. 4 is a schematic circuit diagram showing a backlight control circuit according to an embodiment of the present invention.

FIG. 4 is a schematic circuit diagram showing a backlight control circuit according to an embodiment of the present invention. As shown in the figure, in the backlight control circuit 30, current sources CS1-CSN (shown by circuit blocks) are provided in corresponding LED paths 101-10N respectively, to control the current in respective paths. (An LED path 101-10N is a path from the node of the output voltage Vout to ground.) This embodiment is different from the prior art in that a high-low voltage comparison and amplifier circuit 29 is used to replace the conventional comparison between the lowest voltage among the nodes N11-N1N and the reference voltage Vref. The high-low voltage comparison and amplifier circuit 29 includes a lowest voltage selection circuit 21, a highest voltage selection circuit 22, and an error amplifier circuit (Error Amp.) 13. The high-low voltage comparison and amplifier circuit 29 is capable of comparing the voltage signals representing the current conditions on the LED paths 101-10N.

Figure 5A:
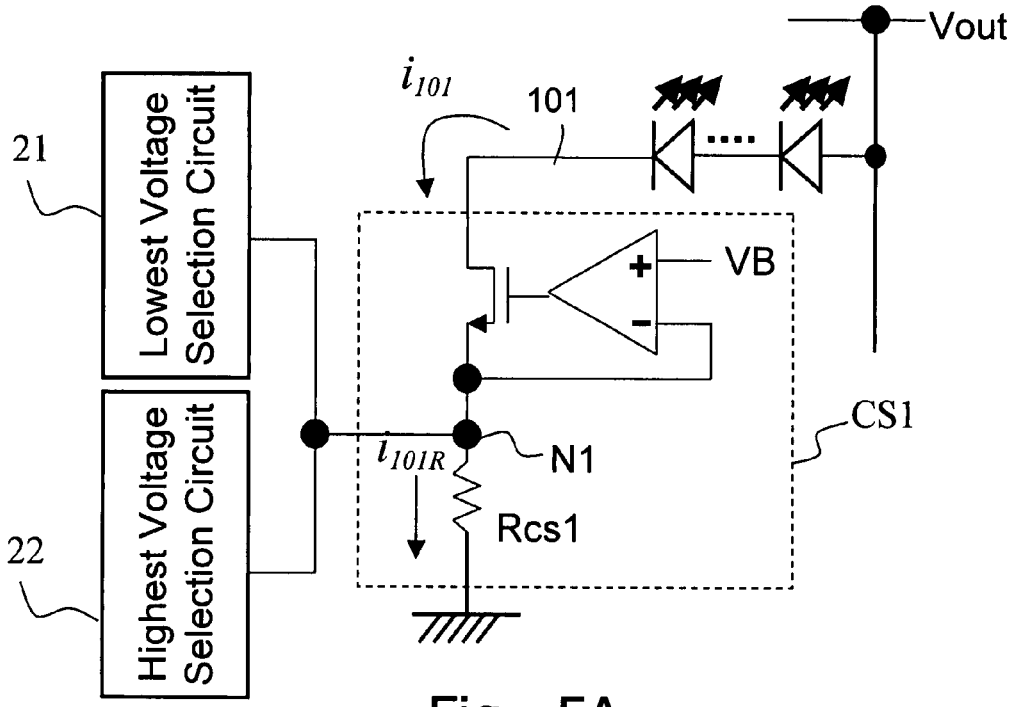
FIG. 5 shows several examples of the locations of the nodes.
Figure 5B:
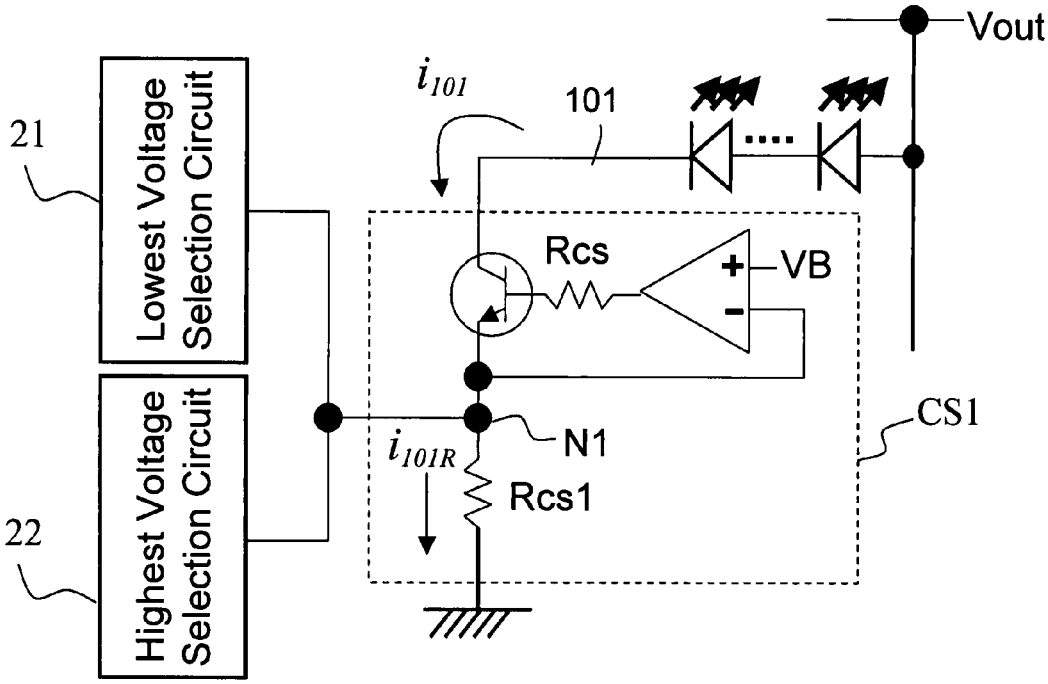

In one embodiment, the voltage signals representing the current conditions on the LED paths 101-10N may be extracted from the nodes N1-NN in the current sources CS1-CSN. Referring to FIGS. 5A and 5B, with the current source CS1 as an example, when the current source CS1 is made of a field effect transistor, the node N1 may be, e.g., its source; when the current source CS1 is made of a bipolar transistor, the node N1 may be, e.g., its emitter. As shown in the figure, the current $i_{101}$ passing through the LED path 101 is substantially equal to the current $i_{101R}$ passing through the resistor Rcs1, so the voltage at the node N1 is substantially equal to the product of the resistance Rcs1 and the current $i_{101R}$. Thus, the voltage at the node N1 can be used to represent the current condition on the LED path 101. Note that the locations of the node N1 shown in the figures are only ones among many possible locations that can achieve the same effect.

The voltages at the nodes N1-NN are inputted to both the lowest voltage selection circuit 21 and the highest voltage selection circuit 22 to select the lowest and highest ones thereof. The lowest and highest voltages are compared in the error amplifier circuit 13, to generate a control signal 15 controlling the voltage supply circuit 11.

Figure 6:
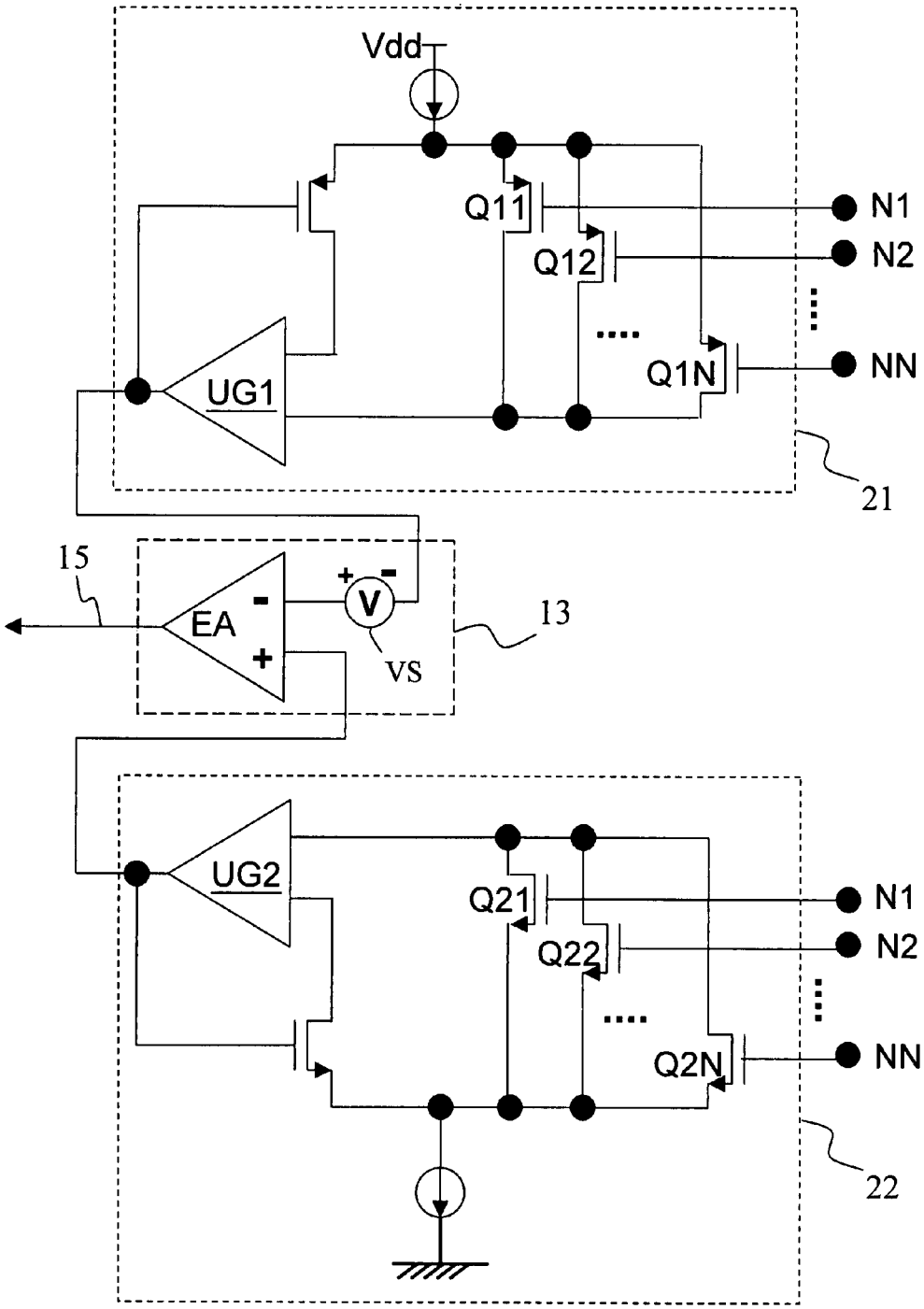
FIG. 6 is a schematic circuit diagram showing an embodiment of the high-low voltage comparison and amplifier circuit according to the present invention.

Please refer to FIG. 6 which shows, by way of example, more details of the circuit of FIG. 4. The circuit 21 at the upper part of the figure selects the lowest voltage among the voltages at the nodes N1-NN and outputs it via a unit gain circuit UG1; the circuit 22 at the lower part of the figure selects the highest voltage among the voltages at the nodes N1-NN and outputs it via a unit gain circuit UG2. Note that, depending on the voltage level of the nodes N1-NN which relate to the selected locations thereof, the transistors Q21 and Q2N may need to be made of transistors of low threshold voltage or depletion mode transistors in some cases. The output voltages of the circuits 21 and 22 are compared in the error amplifier circuit 13 after compensated by a voltage source VS, to generate the control signal 15. In one embodiment, the control signal 15 controls the voltage supply circuit 11 in such manner that when the output of the highest voltage selection circuit 22 is larger than the output of the lowest voltage selection circuit 21 plus the compensation voltage VS, the control signal 15 controls the voltage supply circuit 11 to increase the output voltage Vout; when the output of the highest voltage selection circuit 22 is lower than the output of the lowest voltage selection circuit 21 plus the compensation voltage VS, the control signal 15 controls the voltage supply circuit 11 to decrease the output voltage Vout. In this manner, the output of the highest voltage selection circuit 22 will be kept close or equal to the output of the lowest voltage selection circuit 21 plus the compensation voltage VS. The voltage supply circuit 11 may include any of the following circuits, which operate under the control by the signal 15: a pulse width modulation circuit, a pulse frequency modulation circuit, a pulse skipping modulation circuit, a linear regulator circuit, or other modulation circuits. The details of such circuits are well known to those skilled in this art and therefore omitted here.

Also please note that the voltage source VS is illustrated in the figure to explain the concept of the present invention, which represents a voltage difference that can be achieved in many equivalent ways. In practice, it does not have to provide a physical device. For example, if a proper input offset voltage is provided between the inputs of the error amplifier EA, the same effect can be achieved. As another example, by properly determining the gain of the error amplifier EA, or by adjusting the way the control signal 15 controls the voltage supply circuit 11 (for example by adjusting the modulation gain), the desired effect can be achieved without a physical voltage source VS. As a further example, if the control signal 15 is an analog signal, it can be designed so that when the control signal 15 is above a threshold, the voltage supply circuit 11 increases the output voltage Vout; when the control signal 15 is below the threshold, the voltage supply circuit 11 decreases the output voltage Vout; and optionally, when the control signal 15 is equal to the threshold, the voltage supply circuit 11 keeps the output voltage Vout. The threshold is thus equivalent to providing a voltage source.

The circuits shown in FIGS. 4-6 operate in a manner as described below. When the output voltage Vout can support the normal operation of the LEDs and the current sources CS1-CSN, the currents flowing through the LED paths 101-10N are not too much different from one another. There is only little difference among the voltages at the nodes N1-NN; the difference between the highest voltage and the lowest voltage should be in a reasonably narrow range. However, when the output voltage Vout can not support the normal operation of the LEDs and the current sources CS1-CSN, because the current sources CS1-CSN can not operate normally, the currents flowing through the LED paths 101-10N are significantly different from one another, and the difference between the highest voltage and the lowest voltage at the nodes N1-NN increases beyond the reasonably narrow range. Thus, if the difference between the highest voltage and the lowest voltage at the nodes N1-NN are kept within a certain range by the error amplifier circuit 13 and the voltage supply circuit 11, it can be sure that the LEDs and the current sources CS1-CSN operate normally and the currents flowing through the LED paths 101-10N are not too much different from one another. More importantly, under such control mechanism, the output voltage Vout will be automatically adjusted to the lowest voltage required for the normal operation of the LEDs and the current sources CS1-CSN. More specifically, according to the present invention, if the difference between the highest voltage and the lowest voltage at the nodes N1-NN is lower than a predetermined value, it means that the output voltage Vout is not optimum and can still be lowered. By the dynamic feedback control mechanism of the present invention, the backlight control circuit 30 will automatically decrease the output voltage Vout, until the difference between the highest voltage and the lowest voltage at the nodes N1-NN is equal to the predetermined value. As such, the present invention avoids the problem of manually setting the reference voltage Vref in the prior art, and it has much better power utilization efficiency.

For convenience in explaining the concept of the present invention, it is assumed that there is a physical voltage source VS in the error amplifier circuit 13. The voltage of the voltage source VS is, conceptually, equivalent to the predetermined value for the difference between the highest voltage and the lowest voltage at the nodes N1-NN, and corresponding to the maximum difference between the currents flowing through the LED paths. Thus, the voltage value of the voltage source VS can be set according to the specification of the maximum difference between the brightness of the LEDs in normal operation. In case necessary, the voltage source VS can be set and adjusted externally from outside of the backlight control circuit 30, for example by providing an external resistor.

In the circuits described above, if anyone of the LED paths 101-10N malfunctions, such as if a path is open, there will be no current flowing on the path, and the lowest voltage selection circuit 21 will always select the node corresponding to the open path and output a voltage equal or close to zero. The error amplifier circuit 13 will keep outputting an incorrect control signal 15, and the backlight control circuit 30 can not operate normally.

This issue can be solved by providing under current detection (UCD) circuits to detect whether "no current" or "very low current" condition (collectively, "under current" condition) occurs in any of the LED paths 101-10N. For details of the UCD circuits, please refer to the patent application filed by the same assignee on the same filing date and under the same title. For simplicity, only one example is explained in this specification.

Figure 7:
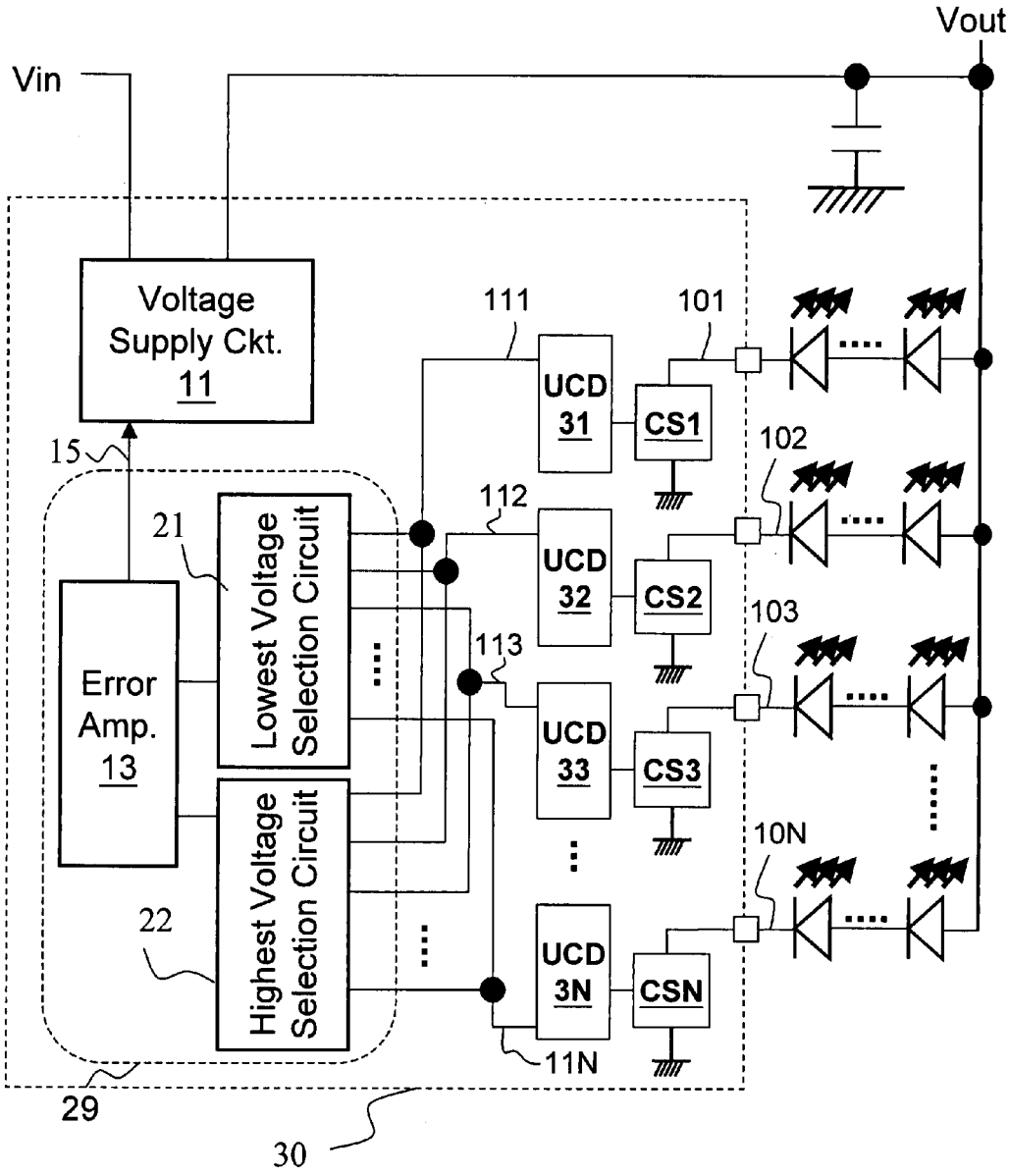
FIG. 7 is a schematic circuit diagram showing a backlight control circuit according to an embodiment of the present invention.

As shown in FIG. 7, the backlight control circuit 30 further comprises under current detection (UCD) circuits 31-3N. The UCD circuits 31-3N detect the current conditions on the LED paths 101-10N to determine whether an under current status, i.e., a "no current" or "very low current" condition, occurs in any of the paths. When "no current" or "very low current" condition does not occur, the voltage signals on the LED paths 101-10N pass through the UCD circuits 31-3N to the corresponding voltage comparison paths 111-11N, so that the high-low voltage comparison and amplifier circuit 29 receives those signals. When anyone or more LED paths 101-10N have no current or very low current, the UCD circuits 31-3N exclude the corresponding one or more voltage comparison paths 111-11N so that they are not valid inputs to the high-low voltage comparison and amplifier circuit 29, that is, the high-low voltage comparison and amplifier circuit 29 does not accept signals on these invalid voltage comparison paths 111-11N.

Figure 8:
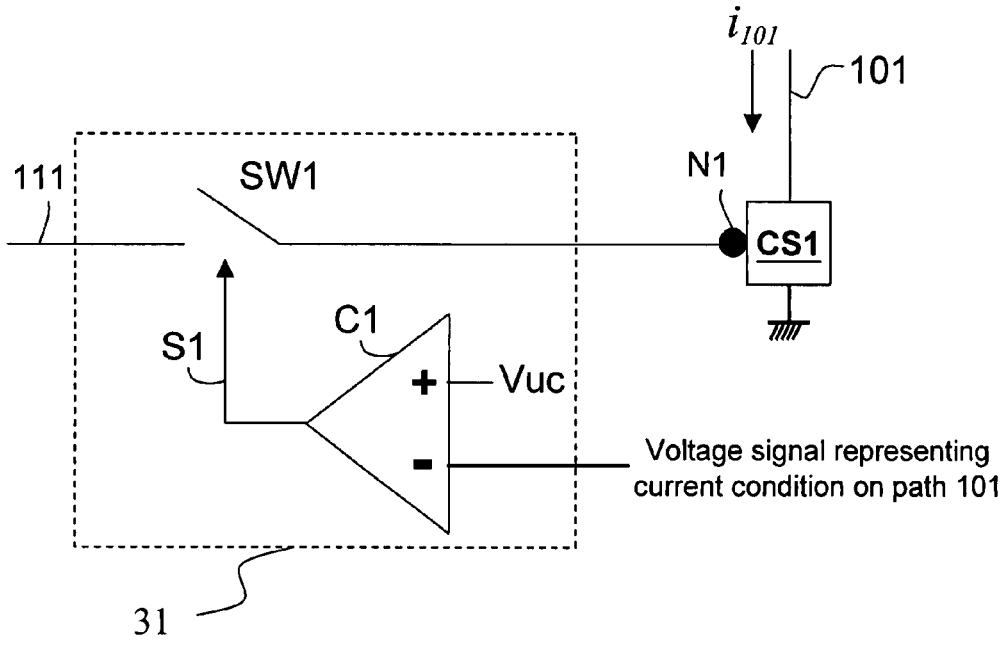
FIG. 8 is a diagram for explaining the concept of under current detection

The foregoing concept can be understood more clearly with reference to FIG. 8, which shows the UCD circuit 31 as an example. The current condition $i_{101}$ on the LED path 101 is converted to a voltage signal, for example by extracting the voltage at the node N1 or by other methods as described in the aforementioned patent application filed by the same assignee on the same filing date and under the same title. The voltage signal is compared with a preset reference voltage Vuc in a comparator C1; the comparison result is represented by a signal S1 which controls a switch SW1 so that when "no current" or "very low current" condition occurs in the path 101, the switch SW1 is opened. (Of course, depending on the design of the switch SW1, the output of the comparator CP1 may need to be inverted.) Note that FIG. 8 is only an example for illustrating the concept; the switch need not necessarily be located in the path 111, as long as the desired effect (to exclude the signal on the path 111 from the inputs of the high-low voltage comparison and amplifier circuit 29) can be achieved, as described in the aforementioned patent application filed by the same assignee on the same filing date and under the same title.

If anyone of the LED paths 101-10N is open or floating, the corresponding UCD circuits 31-3N will cut off the corresponding paths 111-11N. For example, if the LED path 101 is open, because the path 111 is cut off, the lowest voltage selection circuit 21 will select the one with the lowest voltage only from the paths 112-11N and input the selected one to the error amplifier circuit 13. Although the LEDs in the path 101 can not function, the voltage supply circuit 11 can still supply proper voltage to the rest of the operating LEDs; the voltage supply circuit 11 will not increase the output voltage Vout unlimitedly to burn out the circuit. Furthermore, when the number of pins to be connected with LED paths is more than required, the excess pins can be simply floating or grounded; such arrangement does not consume power, nor do the devices connected with the pins have to be high voltage devices.

In the backlight control circuit 30 according to the present invention, if no current flows on one or more of the LED paths 101-10N, the corresponding voltage comparison paths 111-11N are excluded so as not to be an effective input of the high-low voltage comparison and amplifier circuit 29. However, during circuit initialization stage, it is possible that none of the voltage comparison paths 111-11N are valid inputs to the high-low voltage comparison and amplifier circuit 29 because there is no current on all of the LED paths 101-10N. Thus the voltage supply circuit 11 might not be initialized to supply power. There are several solutions to avoid this malfunction; for example, one solution is to generate a shielding signal according to a signal relating to circuit initialization, such as a power on reset signal or a soft start signal, and shield all or part of the detection signals S1-SN generated by the UCD circuits 31-3N. Another solution is to provide a logic circuit so that when all the UCD circuits 31-3N detect the under current condition concurrently, the voltage supply circuit 11 is forced to supply power. Or, a start-up circuit can be provided to ensure that the backlight control circuit 30 operates normally after initialization. For details of the shielding circuit, the logic circuit and the start-up circuit, please refer to the aforementioned patent application filed by the same assignee on the same filing date and under the same title.

For better understanding the present invention, one example is described below. Please refer to FIG. 9, which shows a circuit including the circuit of FIG. 6, UCD circuits, and a start-up circuit (but omitting the error amplifier circuit 13 for simplicity). In this embodiment, the comparators C1-CN generate detection signals according to the under current conditions on the corresponding nodes N1-NN, respectively, to cut off the corresponding switches SW11-SW1N and SW21-SW2N. To cut off the switches SW11-SW1N is equivalent to cutting off the paths from the nodes N1-NN to the transistors Q11-Q1N and pulling up the gate voltages thereof; to cut off the switches SW21-SW2N is equivalent to cutting off the paths from the nodes N1-NN to the transistors Q21-Q2N and pulling down the gate voltages thereof. At circuit initialization stage when all the comparators C1-CN detect the under current condition concurrently, by means of the NAND gate G1 and the AND gate G2, the transistors Q10 and Q20 are still ON. Thus the unit gain circuits UG1 and UG2 are still able to output signals to the error amplifier circuit 13 (not shown), and the error amplifier circuit 13 will generate the control signal 15, controlling the voltage supply circuit 11 to supply power. The gate UG1 will follow the gate G1 to output a low voltage, and the gate UG2 will follow the gate G2 to output a high voltage; thus the voltage supply circuit 11 will increase the output voltage Vout until the circuit leaves the initialization stage, that is, when at least one of the LED paths 101-10N leaves the under current status.

Figure 9:
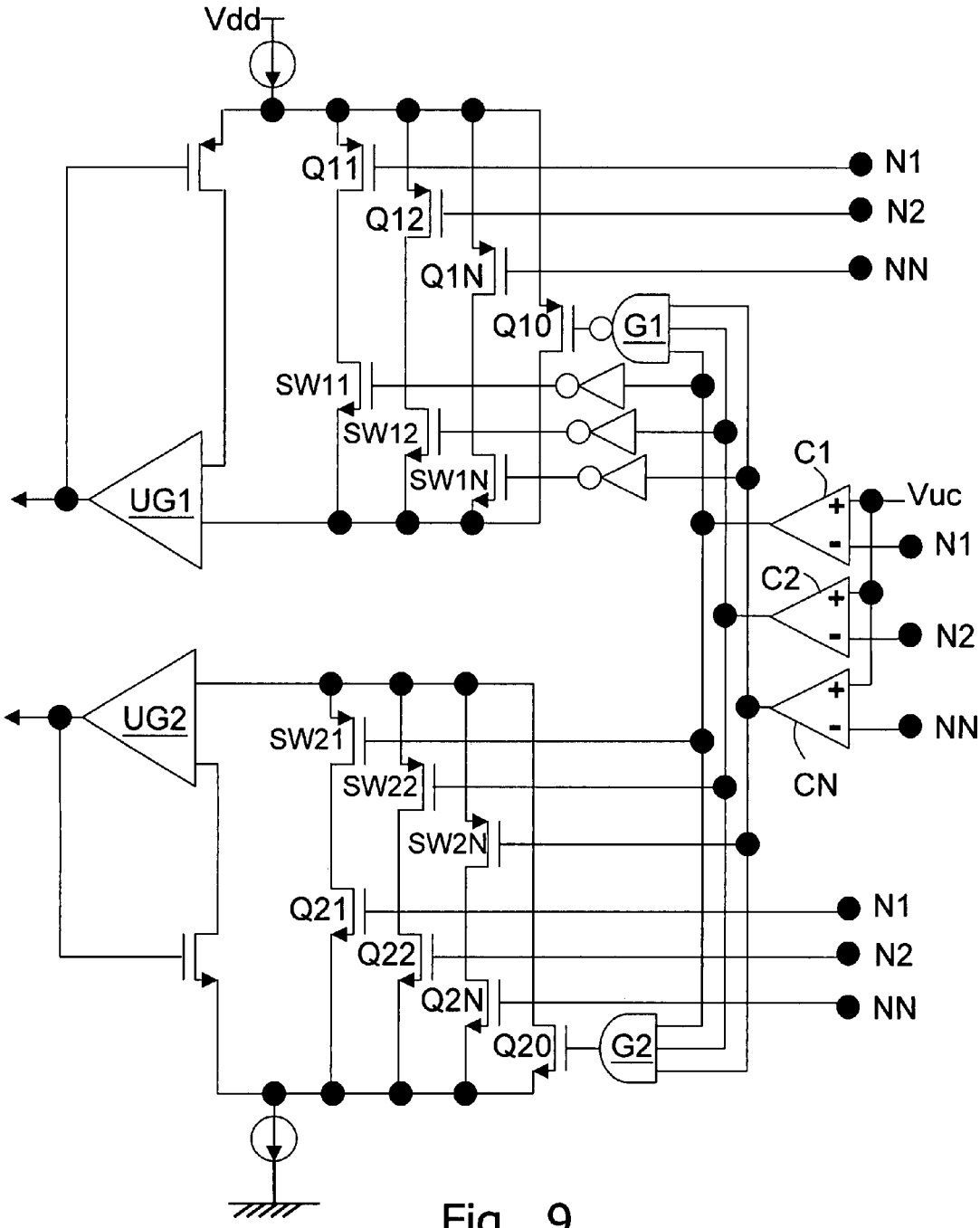
FIG. 9 shows the circuit structure of the embodiment shown in FIG. 6 provided with the UCD circuits and the start-up circuit.

In the embodiment of FIG. 9, the comparators C1-CN, the switches SW11-SW1N and switches SW21-SW2N construct the aforementioned UCD circuits 31-3N; the NAND gate G1 and the transistor Q10 construct a start-up circuit to the lowest voltage selection circuit 21; the AND gate G2 and the transistor Q20 construct a start-up circuit to the highest voltage selection circuit 22. Note that FIG. 9 is only one example among many possible variations.

Furthermore, in the foregoing description, it is assumed that the UCD circuits 31-3N will not concurrently generate low current detection signals in normal operation, except at the circuit initialization stage. However, it is still possible, although very unlikely, that all the UCD circuits 31-3N concurrently generate low current detection signals and it correctly shows that all of the paths 101-10N are inoperative. This is very possibly due to the malfunction of the output voltage Vout, for example because the output terminal is short to ground, or the loading on the paths 101-10N is too much higher than what the output voltage Vout can afford. Under such circumstance, the current from the voltage supply circuit 11 toward the output terminal will drastically increase, so a checking of such "over-current" condition can be made to determine whether the output terminal is grounded or overloaded. When such "over-current" condition occurs, one or more of the following countermeasures can be taken, such as: shutting down the voltage supply circuit 11; limiting the current supplied by the voltage supply circuit 11; shutting down the backlight control circuit; shutting down, and rebooting the backlight control circuit. The checking can be done by, e.g., extracting current from the output terminal of the voltage supply circuit 11, letting the current flow through a resistor, and comparing the voltage across the resistor with a predetermined reference voltage; or, by comparing a voltage across a power device or a switching device in the voltage supply circuit 11 which relates to the output current with a predetermined reference voltage. There are many possible variations that can be readily conceived by those skilled in this art under the teachings of the present invention.

Figure 10:
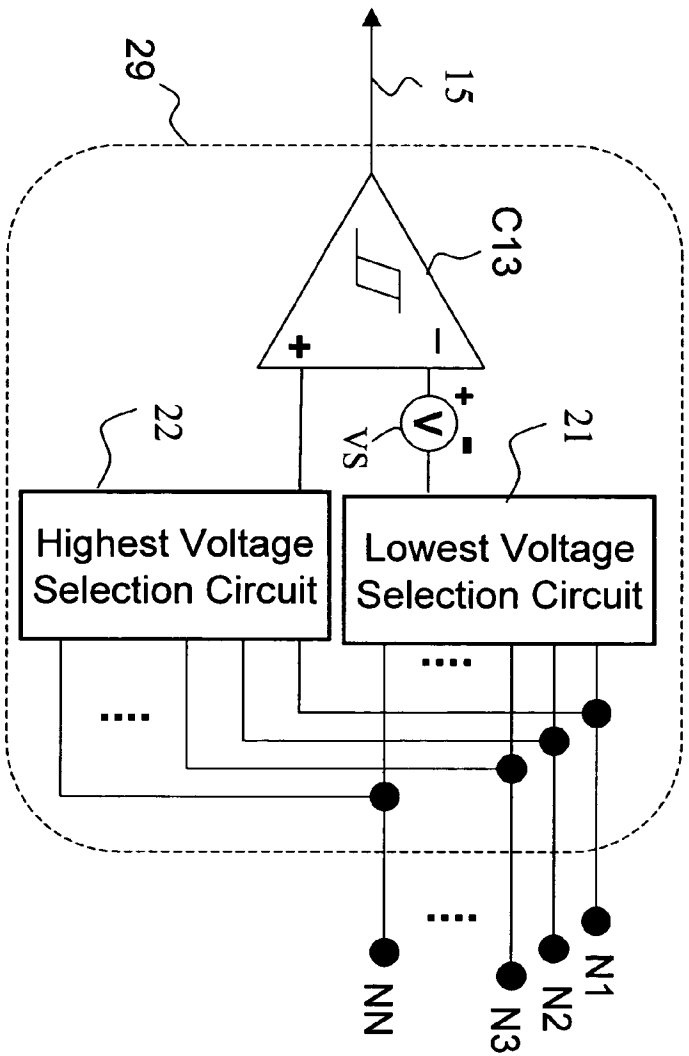
FIG. 10 shows another embodiment of the high-low voltage comparison and amplifier circuit according to the present invention.

In the embodiments of FIGS. 4 and 6, the control signal 15 is generated according to the comparison between the highest voltage and the lowest voltage at the nodes N1-NN, which comparison is performed by an error amplifier circuit 13. However, the use of the error amplifier circuit 13 is only one approach among many variations under the same spirit. By way of example, as shown in FIG. 10, a comparator C13 can be used to generate a digital control signal 15 according to the comparison between the highest voltage and the lowest voltage, and the digital control signal 15 controls the voltage supply circuit 11 to increase or decrease the output voltage Vout in a digital fashion. The voltage supply circuit 11 for example can include a pulse frequency modulation circuit or a pulse skipping modulation circuit controlled by the digital control signal 15, to increase or decrease the output voltage Vout.

The comparator C13 is preferably a hysteretic comparator to filter noises; however, it can be a normal comparator.

Figure 11A:
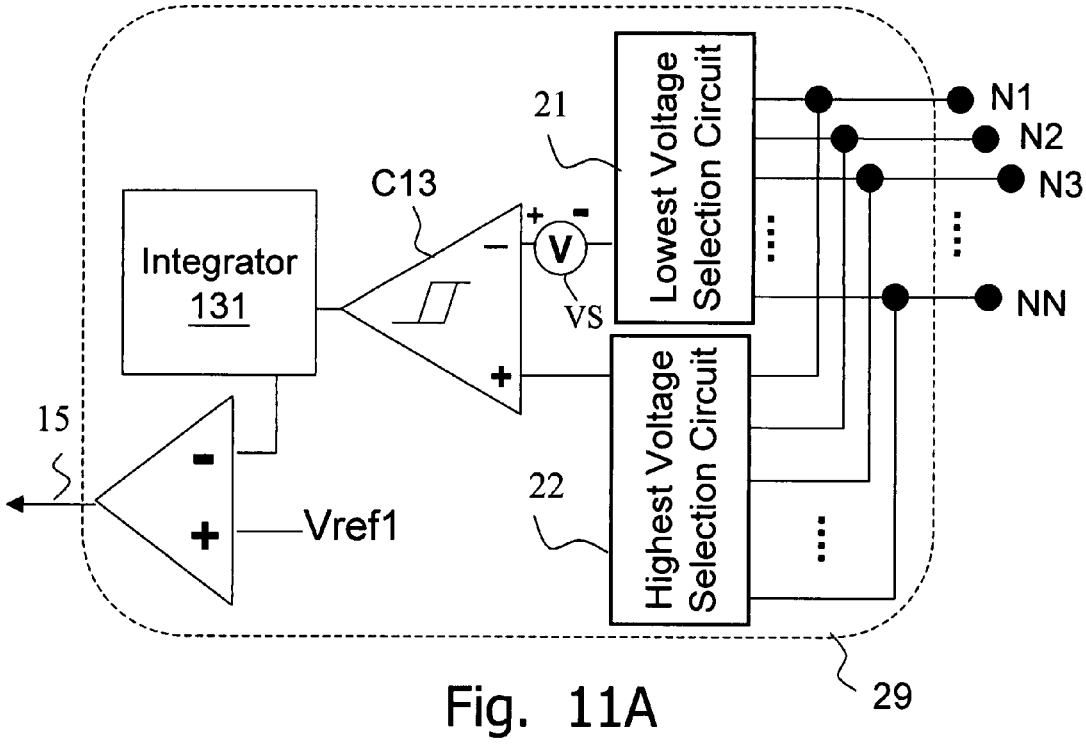
FIG. 11A shows yet another embodiment of the high-low voltage comparison and amplifier circuit according to the present invention.
Figure 11B:
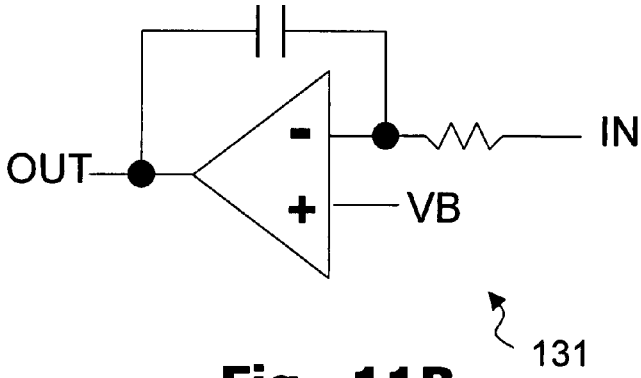
FIG. 11B shows an example of the structure of an integrator.

Referring to FIG. 11A, if it is not desired to control the output voltage Vout in a digital fashion, the output of the comparator C13 can be converted to an analog signal, for example by an integrator 131 shown in the figure, and the converted analog signal is compared with a reference voltage Vref1 to generate the control signal 15. FIG. 11B shows an example of the integrator 131.

Figure 12A:
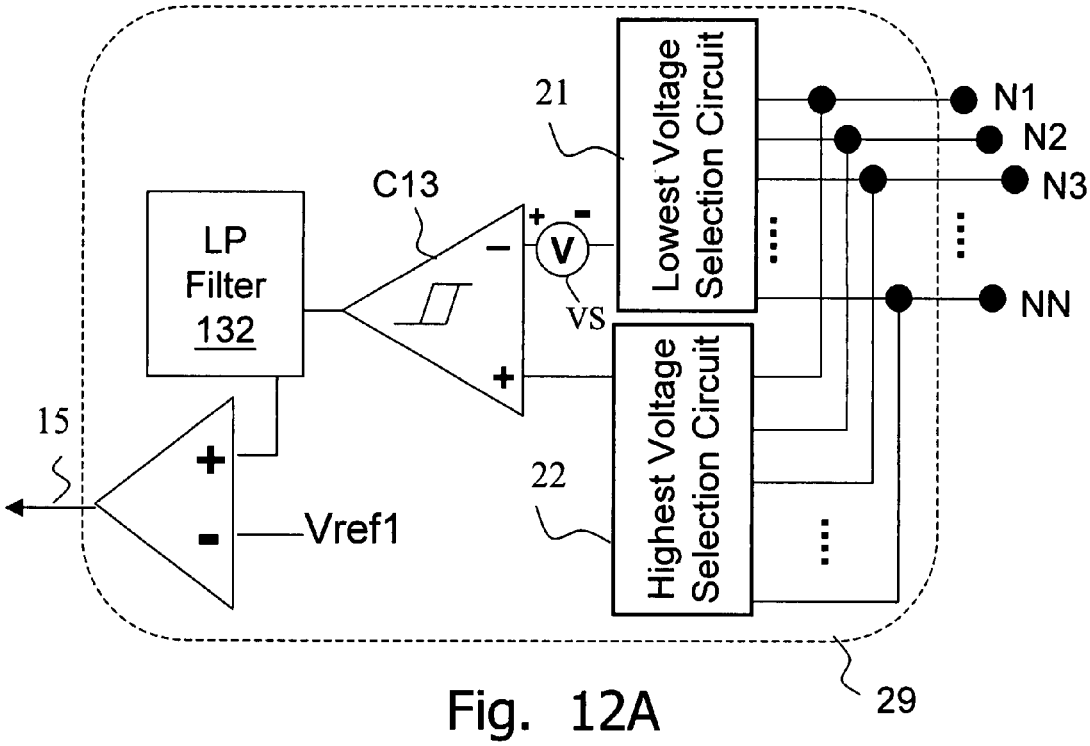
FIG. 12A shows a still other embodiment of the high-low voltage comparison and amplifier circuit according to the present invention.
Figure 12B:
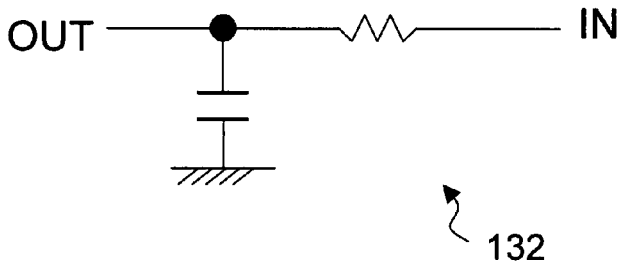
FIG. 12B shows an example of the structure of a low pass filter.

In another embodiment, as shown in FIG. 12A, the output of the comparator C13 can be converted to an analog signal by a low pass filter (LP filter) 132 shown in the figure, and the converted analog signal is compared with a reference voltage Vref1 to generate the control signal 15. FIG. 12B shows an example of the low pass filter 132.

Figure 13A:
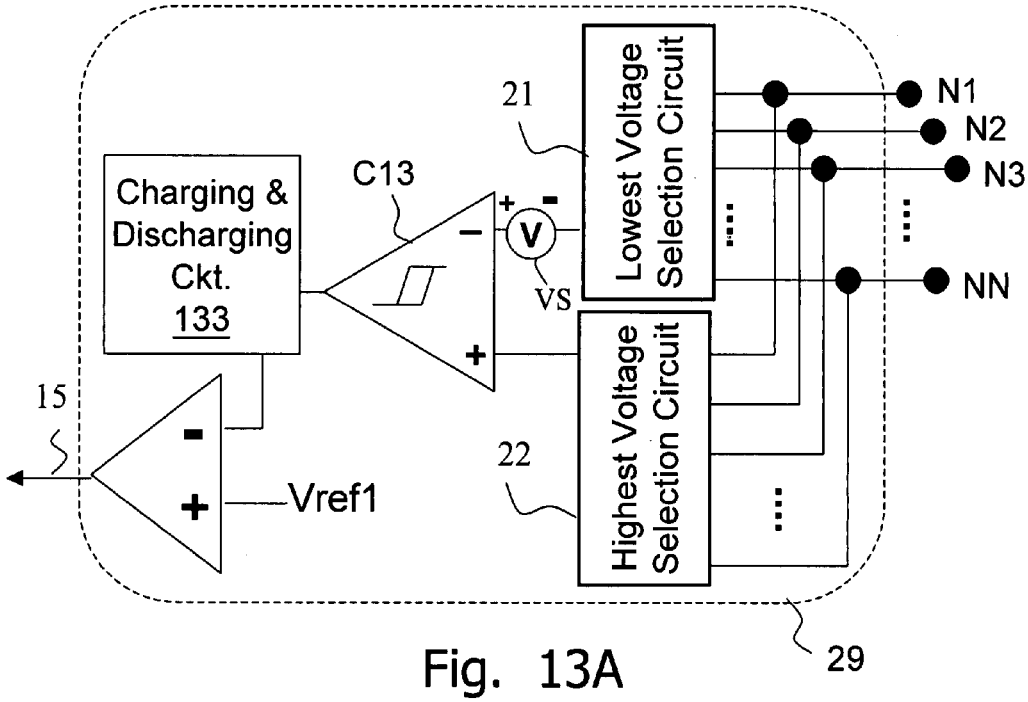
FIG. 13A shows a further other embodiment of the high-low voltage comparison and amplifier circuit according to the present invention.
Figure 13B:
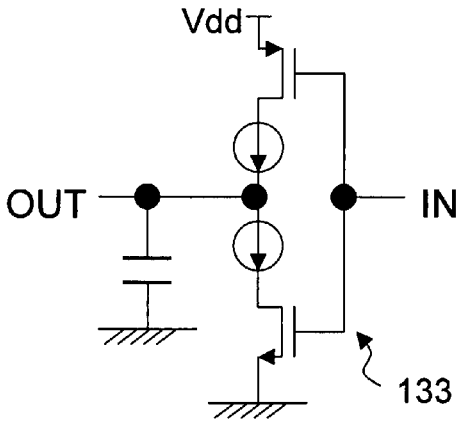
FIGS. 13B and 13C show two examples of the structure of a charging and discharging circuit.
Figure 13C:
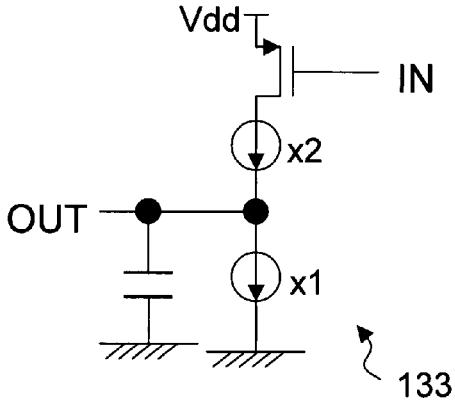

In a further other embodiment, as shown in FIG. 13A, the output of the comparator C13 can be converted to an analog signal by a charging and discharging circuit 133 shown in the figure, and the converted analog signal is compared with a reference voltage Vref1 to generate the control signal 15. FIGS. 13B and 13C show two examples of the charging and discharging circuit 133.

In addition to the above, the digital to analog conversion can be done by various other methods. Note that the reference voltage Vref1 shown in the FIGS. 11-13 is a reference voltage that does not relate to the specification of the circuit; it is not for setting the minimum supply voltage for the LED paths, so it can be set in a wide range without the problem described in the background of this invention.

In all of the aforementioned embodiments, the control signal 15 is generated according to the comparison between the highest voltage and the lowest voltage at the nodes N1-NN. To compare the highest voltage and the lowest voltage is the most straightforward approach, but there are other equivalent ways to achieve the same or similar effect under the same spirit of the present invention. Several examples are described below.

Figure 14A:
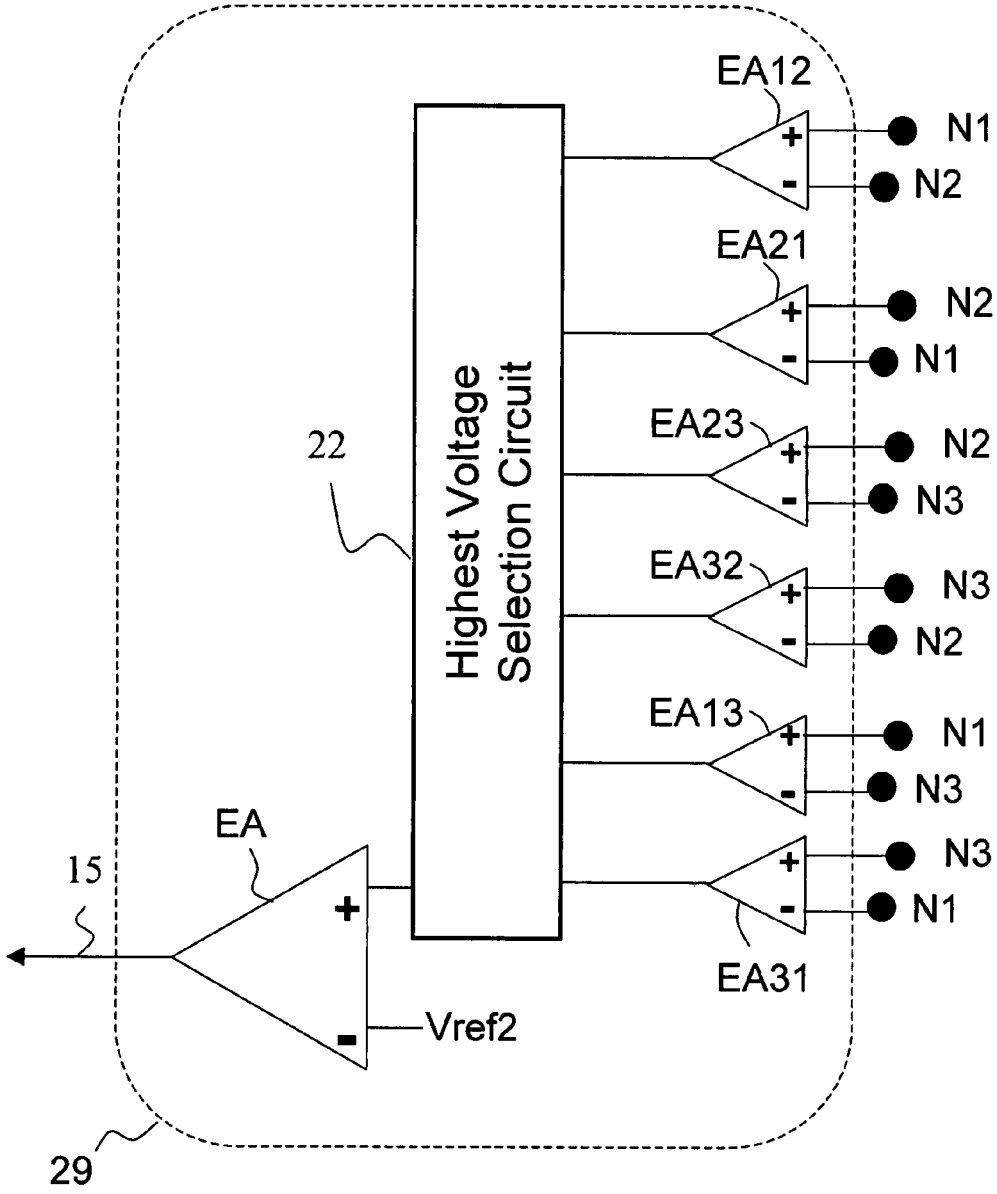
FIG. 14A shows a further other embodiment of the high-low voltage comparison and amplifier circuit according to the present invention.

FIG. 14A shows another embodiment of the high-low voltage comparison and amplifier circuit 29, and for convenience, the total number of the LED paths is shown to be three. In this embodiment, the comparison is not made between the highest voltage and the lowest voltage at the nodes N1-NN, but between any two voltages at the nodes N1-NN. The voltages at the nodes N1-NN are compared with one another, two by two, bidirectionally. More specifically, the error amplifiers EA12 and EA21 respectively receive the voltages at the nodes N1 and N2 as their positive and negative (negative and positive) inputs; the error amplifiers. EA23 and EA32 respectively receive the voltages at the nodes N2 and N3 as their positive and negative (negative and positive) inputs; the error amplifiers EA13 and EA31 respectively receive the voltages at the nodes N1 and N3 as their positive and negative (negative and positive) inputs. As a general rule in this arrangement, if the number of the nodes is N, it requires N(N−1) error amplifiers (wherein N is the number of the nodes). All the outputs of the error amplifiers EA12, EA21, EA23, EA32, EA13 and EA31 are inputted to the highest voltage selection circuit 22 to select the highest one thereof, and it is compared with a reference voltage Vref2 in an error amplifier EA to generate the control signal 15. By the above approach, this embodiment also can provide the desired effect, i.e., to automatically adjust the output voltage Vout according to the largest difference among the voltages at the nodes N1-NN.

Figure 14B:
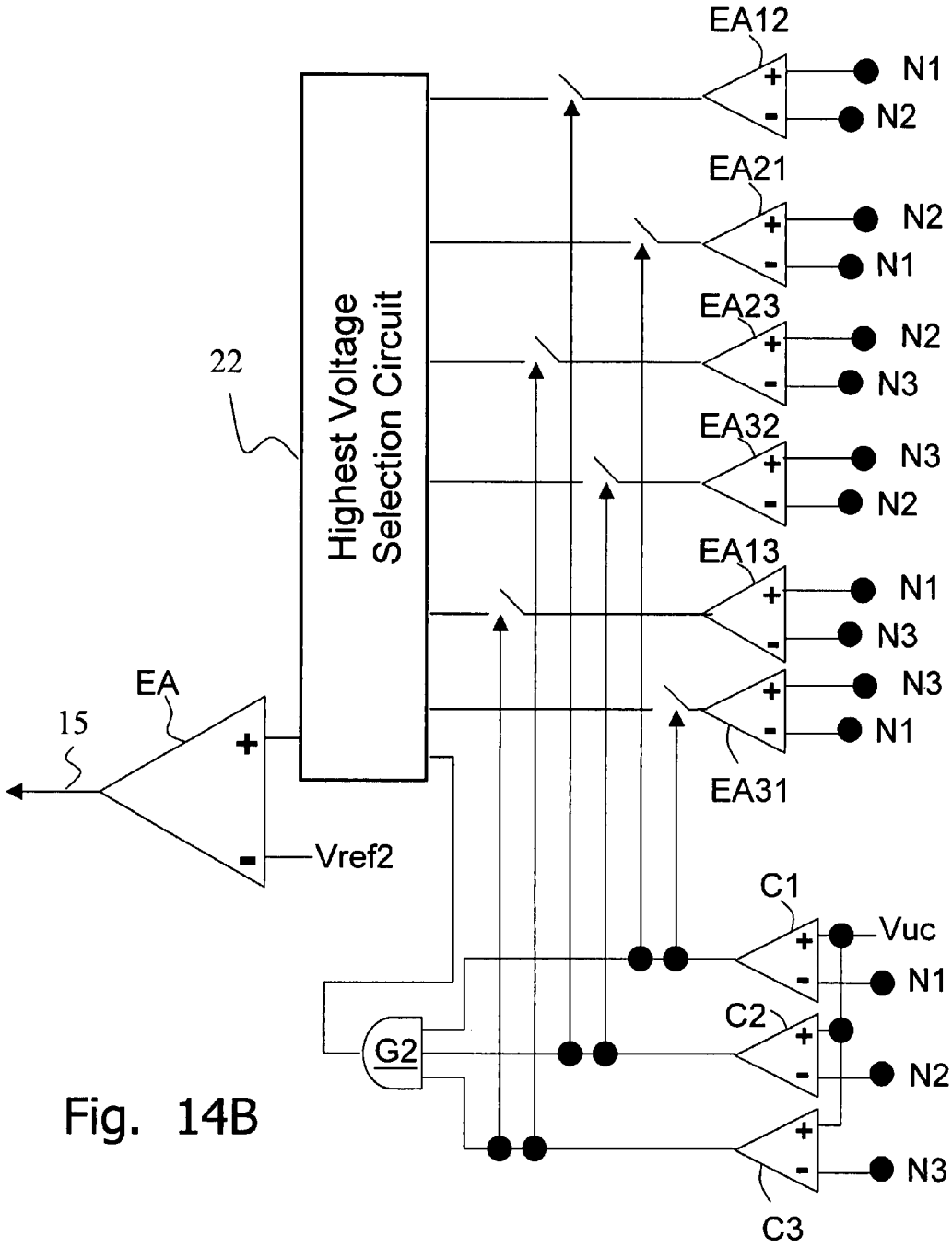
FIG. 14B explains, by way of example, how to provide the UCD circuits and the start-up circuit in the embodiment of FIG. 14A.

The circuit of FIG. 14A can be further provided with UCD circuits and a start-up circuit. By way of example, as shown in FIG. 14B, the circuit further includes comparators C1-C3 and corresponding switches to compose the UCD circuits, and an AND gate G2 providing its output as a start-up input to the highest voltage selection circuit 22. In comparison with the circuit of FIG. 9, there is no lowest voltage selection circuit 21 in the circuit of FIGS. 14A and 14B, so the switches SW11-SW1N, the NAND gate G1 and the transistor Q10 are not required. As stated above, there are various ways to embody the UCD circuits and the start-up circuit; for example, the output signals of the comparators C1-C3 can be used as enable signals to the corresponding error amplifiers, instead of signals for controlling the switches in the paths connected to the outputs of the error amplifiers. All such variations should belong to the scope of the present invention.

Figure 15A:
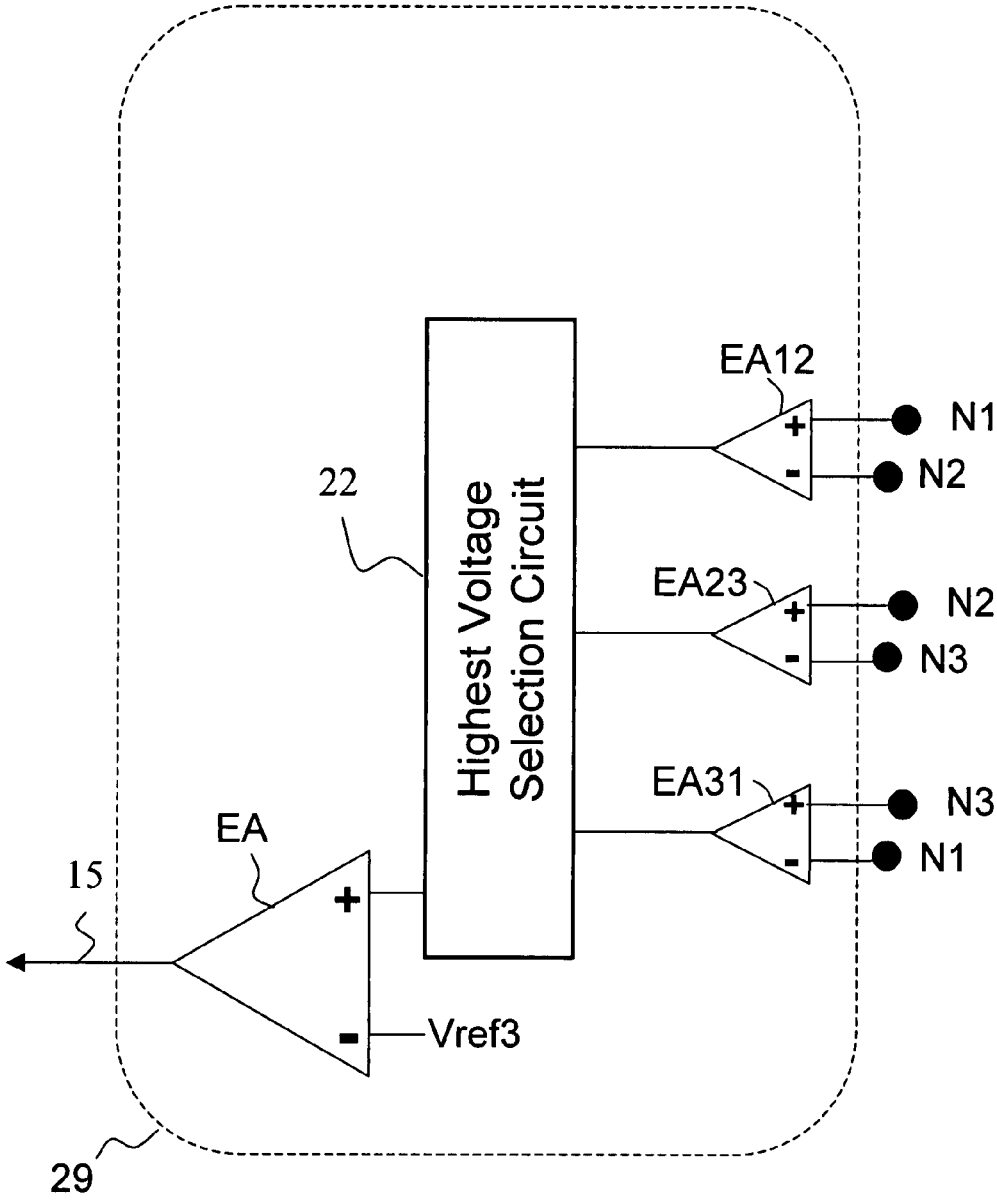
FIG. 15A shows a further other embodiment of the high-low voltage comparison and amplifier circuit according to the present invention.

FIG. 15A shows another embodiment of the high-low voltage comparison and amplifier circuit 29; likely, the total number of the LED paths is shown to be three for convenience. In this embodiment, in order to reduce the hardware cost, the comparison is only made unidirectionally between any two voltages at the nodes N1-NN. More specifically, the error amplifier EA12 receives the voltage at the node N1 as its positive input, and the voltage at the node N2 as its negative input; the error amplifier EA23 receives the voltage at the node N2 as its positive input, and the voltage at the node N3 as its negative input; the error amplifier EA31 receives the voltage at the node N3 as its positive input, and the voltage at the node N1 as its negative input. In comparison with the circuit of FIG. 14A, the error amplifiers EA21, EA32 and EA13 are omitted. Thus if the number of the nodes is N, it requires only N error amplifiers. All the outputs of the error amplifiers EA12, EA23, and EA31 are inputted to the highest voltage selection circuit 22 to select the highest one thereof, and it is compared with a reference voltage Vref3 in an error amplifier EA to generate the control signal 15. In this embodiment, the comparison is not made between the highest voltage and the lowest voltage, but it still can automatically adjust the output voltage Vout according to the largest difference among the voltages at the nodes N1-NN. Note that because the comparison is only made unidirectionally between any two voltages at the nodes N1-NN (for example, N1 is always the positive input when N1 is compared with N2), the reference voltage Vref3 should be set to a value corresponding to 1/(N−1) of the maximum allowable difference between the highest voltage and the lowest voltage at the nodes N1-NN. As such, the tolerance for the two-by-two comparison becomes 1/(N−1) that of the original tolerance specification, wherein N is the number of the nodes.

Figure 15B:
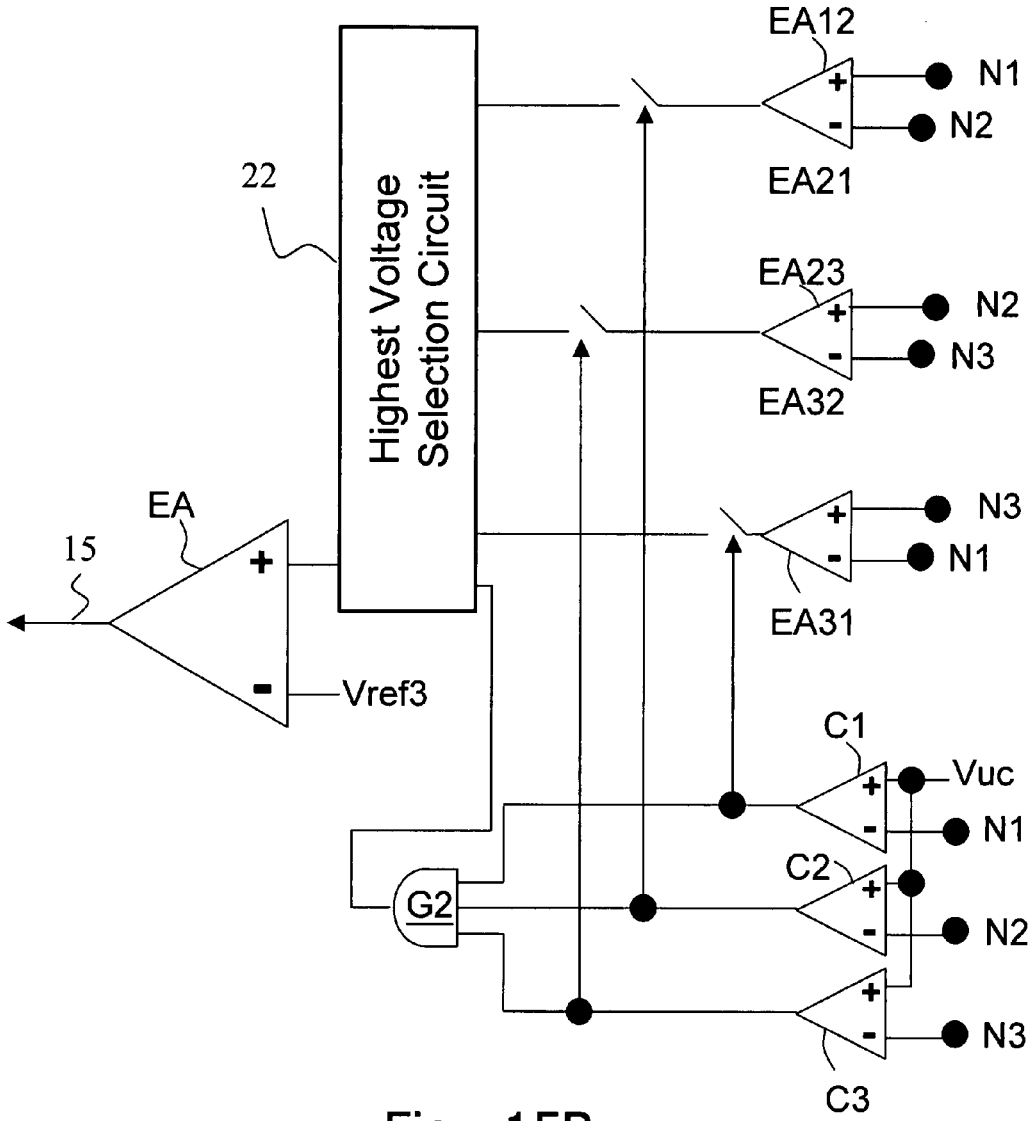
FIG. 15B explains, by way of example, how to provide the UCD circuits and the start-up circuit in the embodiment of FIG. 15A.

The circuit of FIG. 15A may be further provided with UCD circuits and a start-up circuit, as shown in FIG. 15B. It can be seen from comparing FIGS. 15B and 14B that the circuit of FIG. 15B further omits a number switches.

Figure 16:
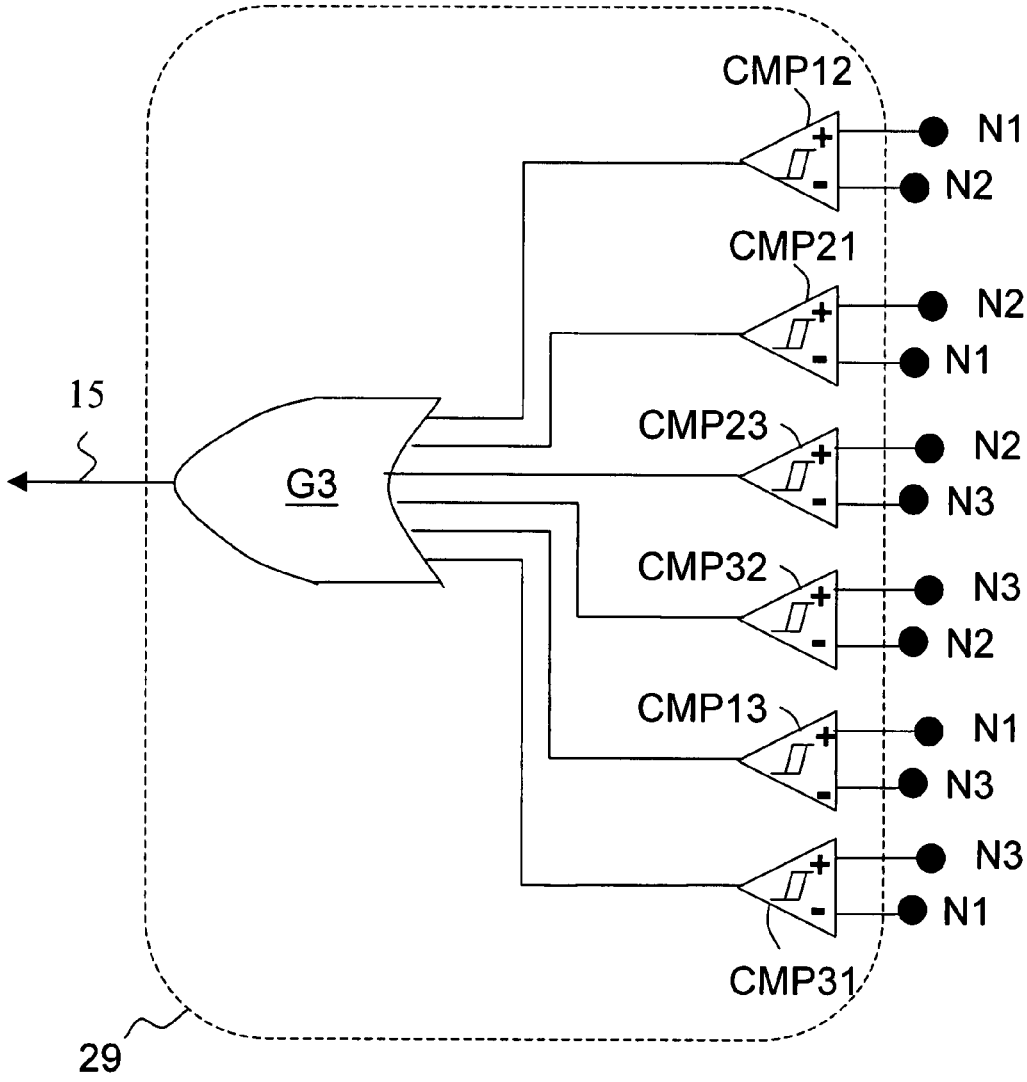
FIG. 16 shows an embodiment wherein the error amplifier is replaced by comparators.
Figure 17:
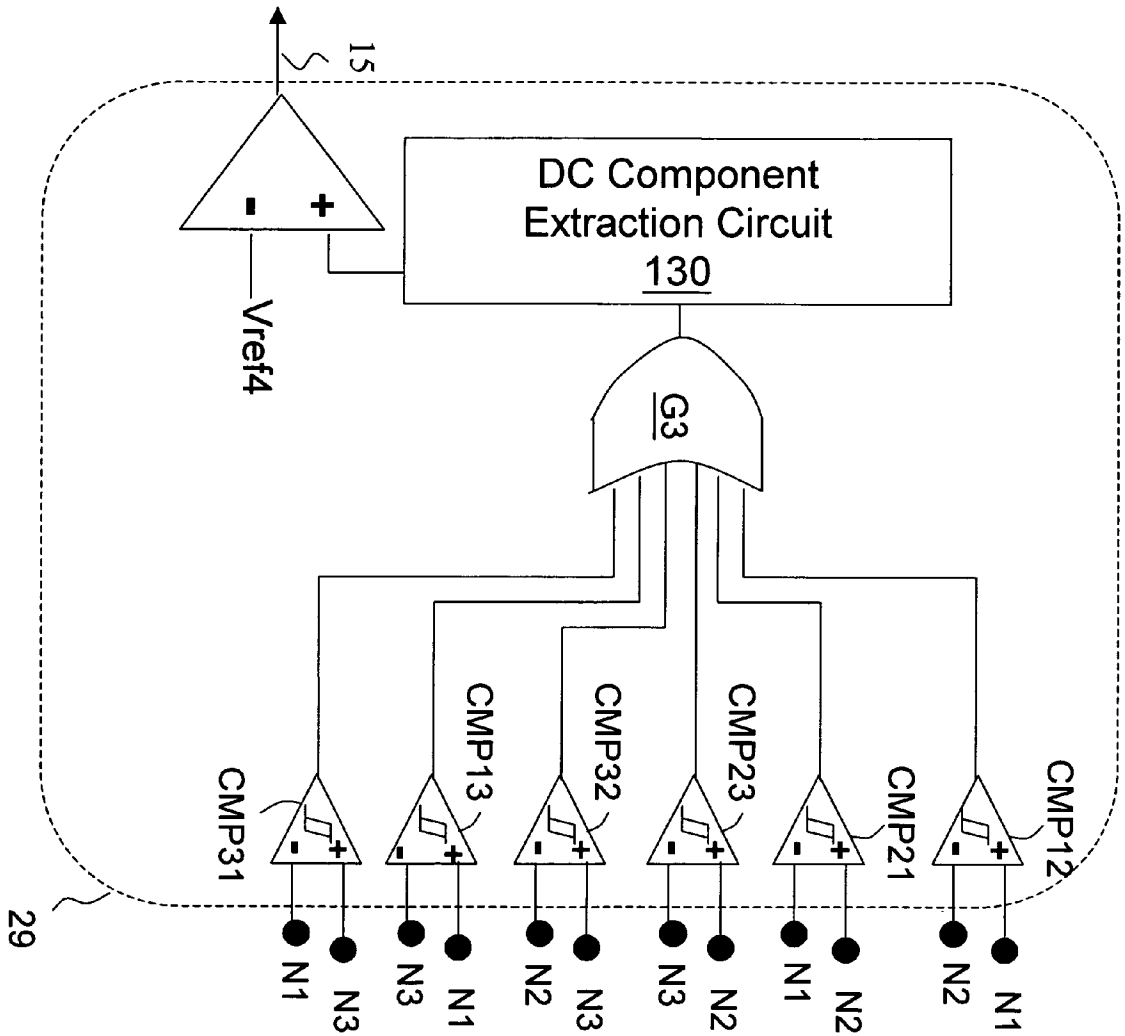
FIG. 17 shows another embodiment to replace the error amplifier by comparators.

In addition to the above, under the same spirit of FIGS. 10-13, the circuits shown in FIGS. 16 and 17 can be obtained by replacing the error amplifiers by comparators. The comparators can be hysteretic comparators or normal comparators (wherein the voltage source VS or an equivalent effect has been provided in each of the comparators). The DC component extraction circuit 130 in FIG. 17 can be the integrator 131, the low-pass filter 132, the charging and discharging circuit 133, or the like.

In the circuits of FIGS. 16 and 17, similar to that in FIG. 15A, comparators CMP 21, CMP32 and CMP 13 can be omitted so that only unidirectional comparison is performed. Furthermore, the circuits of FIGS. 16 and 17 can further include UCD circuits and a startup circuit. In one embodiment, when an LED path is in the low current condition, a circuit is provided to disable a comparator whose input is coupled to a node in the path, or to cut off the output of the comparator; the circuit is thus an UCD circuit. All the output signals of the UCD circuits can be connected to the inputs of an AND gate, and the output of the AND gate is an additional input of the OR gate G3; this arrangement construct a start-up circuit. Such UCD circuit and start-up circuit are not repeatedly illustrated because the same idea has been illustrated in several foregoing embodiments and figures.

Although the present invention has been described in considerable detail with reference to certain preferred embodiments, these embodiments are for illustrative purpose and not for limiting the scope of the present invention. Other variations and modifications are possible. For example, in all of the embodiments, one can insert a circuit which does not affect the primary function, such as a delay circuit, between any two devices which are shown to be directly connected. The backlight control circuit 30 is shown to be one integrated circuit, but it can be divided into several integrated circuits, or integrated with other circuit functions. The present invention is not only applicable to series-parallel connection circuits, but also to all-in-parallel circuits. The light emitting device, although shown as LED in the above, are not limited thereto but can be other light emitting devices such as an organic light emitting diode. And the word "backlight" in the term "backlight control circuit" is not to be taken in a narrow sense that the circuit has to control the backlight of a screen; the present invention can be applied to "active light emission display", or "LED illuminator", or other apparatuses that employ light emitting devices. Therefore, all modifications and variations based on the spirit of the present invention should be interpreted to fall within the scope of the following claims and their equivalents.

What is claimed is:

1. A backlight control circuit, comprising:

a voltage supply circuit, under control by a control signal, for receiving an input voltage and generating an output voltage;

a plurality of nodes for respectively indicating the current status of corresponding light emission device paths, wherein the light emission device paths are coupled to the output voltage and each node corresponds to a different one of the paths; and a high-low voltage comparison and amplifier circuit for generating the control signal according to a voltage difference between at least two of the plurality of nodes, wherein the high-low voltage comparison and amplifier circuit includes:

a lowest voltage selection circuit electrically connected with the plurality of nodes;

a highest voltage selection circuit electrically connected with the plurality of nodes; and an error amplifier circuit having two of its inputs respectively electrically connected with the lowest voltage selection circuit and the highest voltage selection circuit, and an output generating the control signal.

2. The backlight control circuit of claim 1, wherein the high-low voltage comparison and amplifier circuit generates the control signal according to a difference between the highest voltage and lowest voltage at the plurality of nodes.

3. The backlight control circuit of claim 1, wherein the error amplifier circuit includes an error amplifier having one input electrically connected with a voltage source, the voltage source being electrically connected with the lowest voltage selection circuit.

4. The backlight control circuit of claim 1, wherein the lowest voltage selection circuit includes a current source and a plurality of PMOS transistors connected in parallel, the source of each transistor being electrically connected with the current source, and the gate of each transistor being electrically connected with one of the plurality of nodes.

5. The backlight control circuit of claim 1, wherein the highest voltage selection circuit includes a current source and a plurality of PMOS transistors connected in parallel, the source of each transistor being electrically connected with the current source, and the gate of each transistor being electrically connected with one of the plurality of nodes.

6. The backlight control circuit of claim 1, wherein each light emission device path comprises a current source which includes a field effect transistor, and wherein each of the plurality of nodes is a source of the field effect transistor.

7. The backlight control circuit of claim 1, wherein each light emission device path comprises a current source which includes a bipolar transistor, and wherein each of the plurality of nodes is an emitter of the bipolar transistor.

8. A backlight control circuit, comprising:

a voltage supply circuit, under control by a control signal, for receiving an input voltage and generating an output voltage;

a plurality of nodes for respectively indicating the current status of corresponding light emission device paths, wherein the light emission device paths are coupled to the output voltage and each node corresponds to a different one of the paths; and a high-low voltage comparison and amplifier circuit for generating the control signal according to a voltage difference between at least two of the plurality of nodes, wherein the high-low voltage comparison and amplifier circuit includes:

a lowest voltage selection circuit electrically connected with the plurality of nodes;

a highest voltage selection circuit electrically connected with the plurality of nodes; and a comparator circuit having inputs respectively electrically connected with the lowest voltage selection circuit and the highest voltage selection circuit.

9. The backlight control circuit of claim 8, wherein the comparator circuit has an output for generating the control signal.

10. The backlight control circuit of claim 8, wherein the output of the comparator circuit is converted to an analog signal, which is compared with a reference voltage to generate the control signal.

11. The backlight control circuit of claim 10, wherein the output of the comparator circuit is converted to the analog signal by one of the following circuits: an integrator, a low pass filter, or a charging and discharging circuit.

12. The backlight control circuit of claim 8, wherein the comparator circuit includes a comparator having an input electrically connected with a voltage source, the voltage source being electrically connected with the lowest voltage selection circuit.

13. A backlight control circuit, comprising:

a voltage supply circuit, under control by a control signal, for receiving an input voltage and generating an output voltage;

a plurality of nodes for respectively indicating the current status of corresponding light emission device paths, wherein the light emission device paths are coupled to the output voltage and each node corresponds to a different one of the paths; and a high-low voltage comparison and amplifier circuit for generating the control signal according to a voltage difference between at least two of the plurality of nodes, wherein the high-low voltage comparison and amplifier circuit includes:

a plurality of comparators, each comparator having two inputs respectively electrically connected with two of the plurality of nodes; and an OR gate having inputs electrically connected with the outputs of the plurality of comparators, wherein the output of the OR gate is converted to an analog signal by one of the following circuits: an integrator, a low pass filter, or a charging and discharging circuit, and the converted analog signal is compared with a reference voltage to generate the control signal.

14. A backlight control circuit, comprising:

a voltage supply circuit, under control by a control signal, for receiving an input voltage and generating an output voltage;

a plurality of nodes for respectively indicating the current status of corresponding light emission device paths, wherein the light emission device paths are coupled to the output voltage and each node corresponds to a different one of the paths;

a high-low voltage comparison and amplifier circuit for generating the control signal according to a voltage difference between at least two of the plurality of nodes, and at least one under current detection circuit for detecting whether at least one of the light emission device paths is in an under current condition, and when the under current condition occurs, the under current detection circuit sends an exclusion signal to exclude a corresponding node so that it is not a valid input of the high-low voltage comparison and amplifier circuit.

15. The backlight control circuit of claim 14, further comprising a start-up circuit to ensure that the backlight control circuit does not malfunction according to the exclusion signal during circuit initialization stage.

* * * * *